US009673029B2

(12) United States Patent
Brown et al.

(10) Patent No.: US 9,673,029 B2
(45) Date of Patent: Jun. 6, 2017

(54) AUTOMATED TUNING FOR MALDI ION IMAGING

(71) Applicant: Micromass UK Limited, Wilmslow (GB)

(72) Inventors: Jeffery Mark Brown, Hyde (GB); Paul Murray, Manchester (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/775,768

(22) PCT Filed: Mar. 14, 2014

(86) PCT No.: PCT/GB2014/050805

§ 371 (c)(1),
(2) Date: Sep. 14, 2015

(87) PCT Pub. No.: WO2014/140625

PCT Pub. Date: Sep. 18, 2014

(65) Prior Publication Data

US 2016/0027625 A1 Jan. 28, 2016

(30) Foreign Application Priority Data

Mar. 15, 2013 (EP) ..... 13159559
Mar. 15, 2013 (GB) ..... 1304747.7

(51) Int. Cl.
*H01J 49/00* (2006.01)
*H01J 49/14* (2006.01)
*H01J 49/16* (2006.01)

(52) U.S. Cl.
CPC ..... *H01J 49/0004* (2013.01); *H01J 49/0009* (2013.01); *H01J 49/142* (2013.01); *H01J 49/164* (2013.01)

(58) Field of Classification Search
USPC ..... 250/281, 282
See application file for complete search history.

(56) References Cited

U.S. PATENT DOCUMENTS

| | | | |
|---|---|---|---|
| 6,956,208 | B2 | 10/2005 | Reilly et al. |
| 7,385,192 | B2 | 6/2008 | Haase et al. |
| 7,655,476 | B2 | 2/2010 | Bui |
| 7,851,744 | B2 | 12/2010 | Brown et al. |
| 8,912,485 | B2 | 12/2014 | Maier et al. |
| 2002/0037517 | A1 | 3/2002 | Hutchens et al. |
| 2006/0247863 | A1 | 11/2006 | Bui |
| 2013/0274143 | A1 | 10/2013 | Emanuele et al. |

FOREIGN PATENT DOCUMENTS

WO 2011068654 6/2011

OTHER PUBLICATIONS

Guenther et al., "*Laser Spot Size and Laser Power Dependence of Ion Formation in High Resolution MALDI Imaging*", International Journal of Mass Spectrometry, vol. 294, No. 1, pp. 7-15, 2010.

*Primary Examiner* — Nicole Ippolito
*Assistant Examiner* — Hanway Chang
(74) *Attorney, Agent, or Firm* — Diederiks & Whitelaw, PLC

(57) ABSTRACT

A method of ion imaging is disclosed comprising testing a first portion of a sample by automatically varying one or more parameters of a laser or other ionization device and manually or automatically determining from the first portion one or more optimum or preferred parameters of the laser or other ionization device. A second portion of the sample is then analyzed using the one or more optimum or preferred parameters.

14 Claims, 1 Drawing Sheet

| Y-axis | | 20 shots | 40 shots | 60 shots | 80 shots | 100 shots | 120 shots | 140 shots | 160 shots |
|---|---|---|---|---|---|---|---|---|---|
| 0.0mm | 20μJ | 162 | 241 | 201 | 237 | 239 | 291 | 135 | 275 |
| 0.2mm | 40μJ | 295 | 285 | 270 | 780 | 874 | 486 | 327 | 265 |
| 0.4mm | 60μJ | 219 | 178 | 150 | 1264 | 1449 | 795 | 416 | 230 |
| 0.6mm | 80μJ | 213 | 121 | 301 | 611 | 878 | 377 | 397 | 294 |
| 0.8mm | 100μJ | 243 | 251.5 | 302.5 | 424 | 527 | 315 | 163.5 | 300 |

X-axis 0.0mm 0.2mm 0.4mm 0.6mm 0.8mm 1.0mm 1.2mm 1.4mm

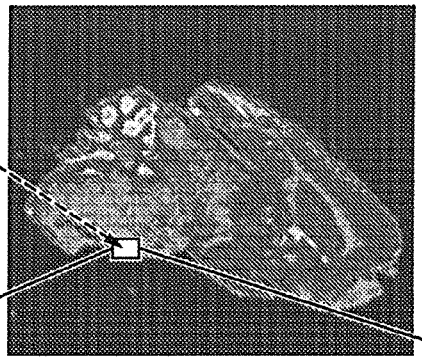
| Y-axis | | 20 shots | 40 shots | 60 shots | 80 shots | 100 shots | 120 shots | 140 shots | 160 shots |
|---|---|---|---|---|---|---|---|---|---|
| 0.0mm | 20μJ | 182 | 241 | 201 | 237 | 239 | 291 | 135 | 275 |
| 0.2mm | 40μJ | 295 | 285 | 270 | 780 | 874 | 486 | 327 | 265 |
| 0.4mm | 60μJ | 219 | 178 | 150 | 1264 | 1449 | 795 | 416 | 230 |
| 0.6mm | 80μJ | 213 | 121 | 301 | 611 | 878 | 377 | 397 | 294 |
| 0.8mm | 100μJ | 243 | 251.5 | 302.5 | 424 | 527 | 315 | 163.5 | 300 |
| | X-axis | 0.0mm | 0.2mm | 0.4mm | 0.6mm | 0.8mm | 1.0mm | 1.2mm | 1.4mm |
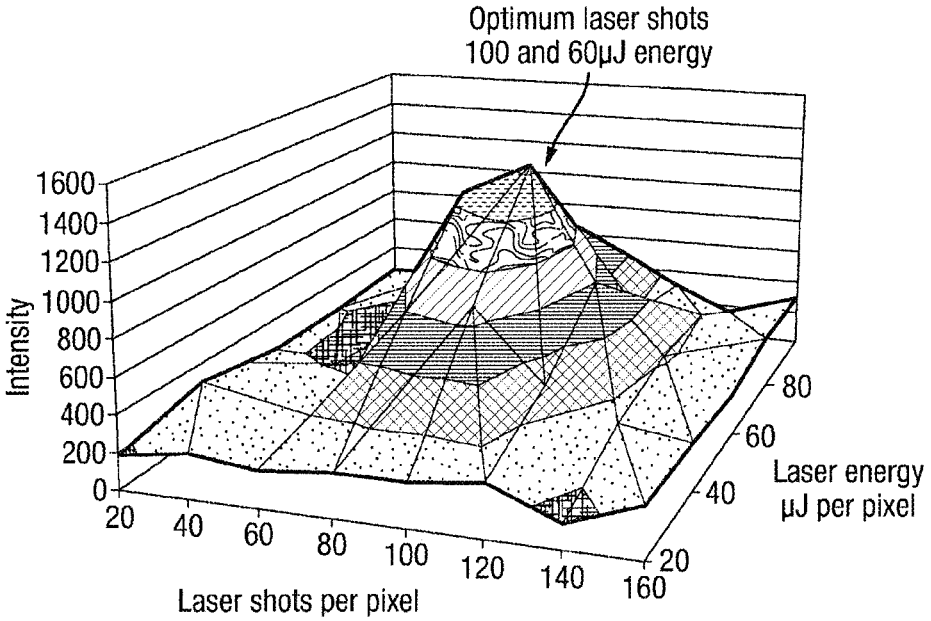

AUTOMATED TUNING FOR MALDI ION IMAGING

CROSS-REFERENCE TO RELATED APPLICATION

This application is the National Stage of International Application No. PCT/GB2014/050805, filed 14 Mar. 2014 which claims priority from and the benefit of United Kingdom patent application No. 1304747.7 filed on 15 Mar. 2013 and European patent application No. 13159559.7 filed 15 Mar. 2013. The entire contents of these applications are incorporated herein by reference.

BACKGROUND OF THE PRESENT INVENTION

The present invention relates to a method of ion imaging, a method of mass spectrometry and a mass spectrometer.

Biological tissue sections for ion imaging experiments may take several hours to prepare often with a large degree of variability in matrix deposition thickness and crystal conformation. As such, the optimum parameters for generating analyte ion signals from biological tissues (or other surfaces) can vary significantly from sample to sample. Matrix Assisted Laser Desorption Ionisation ("MALDI") is a destructive ionisation process and it is therefore important for an operator to know the best parameters to use for each sample loaded into the instrument source. Presently, the optimum parameters are found by trial and error. If non-optimum tuning parameters are used then the user not only wastes the sample but the time involved in preparing the sample and acquiring the data is also wasted.

Important tuning parameters in MALDI ionisation include the number of laser shots per pixel.

If the system is set to acquire too many shots per pixel then the sample/matrix will burn through too quickly and a large proportion of laser shots will not contribute to the analyte signal of interest and will reduce the signal to noise and increase the analysis time.

Laser energy per shot is also crucial with the optimum usually being within a narrow range of values and is heavily dependent upon the sample. The optimum value is also related to the number of laser shots parameter for each pixel. As such, tuning parameters are often non-orthogonal thereby compounding the problem.

US 2007/0141719 (Bui) discloses a method for reducing scan times in mass spectral tissue imaging studies.

US 2006/0186332 (Haase) discloses a laser system for ionisation of a sample using MALDI techniques. The characteristics of the laser beam can be altered by mechanically adjusting a lens assembly or by using a beam attenuator.

US 2011/0272573 (Kostrzewa) discloses an acquisition technique for MALDI time of flight mass spectra.

It is desired to provide an improved method of ion imaging.

SUMMARY OF THE PRESENT INVENTION

According to an aspect of the present invention there is provided a method of ion imaging comprising:

testing a first portion of a sample by automatically varying one or more parameters of a laser or other ionisation device;

manually or automatically determining from the first portion one or more optimum or preferred parameters of the laser or other ionisation device; and then analysing a second portion of the sample using the one or more optimum or preferred parameters.

A MALDI auto-tuning method for ion imaging is disclosed which seeks to optimise analytical ion signals from a biological tissue sample. Prior to ion imaging a spatial data array is preferably acquired from a sacrificial area and the instrument parameters are preferably changed and recorded from pixel to pixel.

From a pseudo-image generated from the sacrificial area, the parameters that were used to generate the highest quality pixels are then preferably used for subsequent analysis of the remaining tissue area.

The preferred embodiment solves the problem of generating optimum tuning conditions for a particular tissue section when performing ion imaging.

US 2007/0141719 (Bui) discloses a method for reducing scan times in mass spectral tissue imaging studies. US 2007/0141719 (Bui) is not concerned with seeking to optimise operational parameters of the laser and hence does not disclose testing a first portion of a sample by automatically varying one or more parameters of a laser or other ionisation device or manually or automatically determining from the first portion one or more optimum or preferred parameters of the laser or other ionisation device.

The first portion preferably comprises a test portion or a sacrificial region of the sample.

The step of testing the first portion of the sample preferably comprises obtaining data from an array of pixels across the first portion.

The method preferably further comprises manually or automatically determining which pixel corresponds with the greatest, optimal or preferred intensity of ions of interest.

The method preferably further comprises manually or automatically determining one or more parameters of the laser or other ionisation device which result in the greatest, optimal or preferred intensity of ions of interest.

The step of automatically varying the one or more parameters preferably comprises automatically varying the number of laser shots per pixel.

The step of automatically varying the one or more parameters preferably comprises automatically varying the laser energy per pixel.

According to another aspect of the present invention there is provided a method of ion imaging comprising: automatically acquiring an array of mass spectral data from a portion of a sample;

manually or automatically determining one or more optimum or preferred operating conditions from the array of mass spectral data; and ion imaging the sample using the one or more optimum or preferred operating conditions.

According to another aspect of the present invention there is provided a method of mass spectrometry comprising a method of ion imaging as described above.

The method preferably further comprises ionising the sample using a Matrix Assisted Laser Desorption Ionisation ("MALDI") ion source, a Secondary Ions Mass Spectrometry ("SIMS") ion source, a Desorption Electrospray Ionisation ("DESI") ion source or a Direct Analysis in Real Time ("DART") ion source.

According to another aspect of the present invention there is provided a mass spectrometer comprising:

a laser or other ionisation device; and a control system arranged and adapted:

(i) to test a first portion of a sample by varying one or more parameters of the laser or other ionisation device;

(ii) to determine from the first portion one or more optimum or preferred parameters of the laser or other ionisation device; and then (iii) to analyse a second portion of the sample using the one or more optimum or preferred parameters.

According to another aspect of the present invention there is provided a mass spectrometer comprising:

a control system arranged and adapted:

(i) to acquire an array of mass spectral data from a portion of a sample;

(ii) to determine one or more optimum or preferred operating conditions from the array of mass spectral data; and (iii) to perform ion imaging of the sample using the one or more optimum or preferred operating conditions.

The mass spectrometer preferably further comprises a Matrix Assisted Laser Desorption Ionisation ("MALDI") ion source, a Secondary Ions Mass Spectrometry ("SIMS") ion source, a Desorption Electrospray Ionisation ("DESI") ion source or a Direct Analysis in Real Time ("DART") ion source.

According to another aspect of the present invention there is provided a method of ion mapping or ion imaging comprising:

analysing a portion of a sample using a Matrix Assisted Laser Desorption Ionisation ("MALDI") or other laser ion source and automatically varying the intensity of a laser and/or the number of laser shots per pixel across the portion of the sample;

automatically determining the optimum or preferred laser intensity and/or the optimum or preferred number of laser shots per pixel; and then ion mapping or ion imaging the sample using the determined optimum or preferred intensity and/or the optimum or preferred number of laser shots per pixel.

According to another aspect of the present invention there is provided an analytical device arranged and adapted to ion map or ion image a sample comprising:

a device arranged and adapted to analyse a portion of sample using a Matrix Assisted Laser Desorption Ionisation ("MALDI") or other laser ion source and to vary the intensity of a laser and/or the number of laser shots per pixel across the portion of the sample;

a device arranged and adapted to determine the optimum or preferred laser intensity and/or the optimum or preferred number of laser shots per pixel; and a device arranged and adapted to ion map or ion image the sample using the determined optimum or preferred intensity and/or the optimum or preferred number of laser shots per pixel.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments of the present invention will now be described, by way of example only, and with reference to the accompanying drawing in which:

FIG. 1 shows a sample located on a target plate and highlights a small sacrificial area which is analysed according to a preferred embodiment of the present invention to determine the optimum number of laser shots and optimum laser energy per pixel for performing a subsequent method of ion imaging on the rest of the sample.

DETAILED DESCRIPTION OF PREFERRED EMBODIMENTS

A preferred embodiment of the present invention will now be described with reference to FIG. 1.

FIG. 1 shows a sample target plate and a small sacrificial area (adjacent to the main region of interest) which may be moved in a x-y array or translation stage.

A 40 pixel (8×5) regular array of data was obtained from the sacrificial or test area. The pixels of the array were separated by 0.2 mm in the x- and y-directions. The sacrificial area shown is FIG. 1 had a size of 1.4 mm×0.8 mm.

According to the preferred method the parameters of the laser were varied for both the x- and y-axes of the sacrificial or test area. In particular, the number of laser shots per pixel was varied along the x-axis and the intensity or energy per laser shot was varied along the y-axis.

For the x-axis, the number of laser shots was varied from 20 to 160 shots in increments of 20 shots for each coordinate. For the y-axis the laser energy per shot was varied from 20 μJ to 100 μJ in increments of 20 μJ for each coordinate.

It can be seen from the pseudo-image shown in FIG. 1 and the corresponding table that the most intense signal was observed with 100 laser shots each at 60 μJ. This occurred at x=0.8 mm and y=0.4 mm in the array.

For the remaining acquisition over the rest of the tissue section the system was programmed to acquire data at 100 shots per pixel and with a laser energy of 60 μJ per shot or pixel.

According to other embodiments the preferred approach may be used with other ion imaging techniques such as Secondary Ions Mass Spectrometry ("SIMS") and ambient ion imaging techniques such as Desorption Electrospray Ionisation ("DESI") and Direct Analysis in Real Time ("DART") ionisation.

Further embodiments comprise multidimensional arrays with optimisation of other orthogonal and non-orthogonal experimental variables.

Different definitions of pixel quality may be used for obtaining the optimum parameters e.g. signal to noise ("S/N"), ion signal, MS/MS MRM ratios.

Generic auto-tuning from MALDI sample spots (non-ion imaging type analysis) is also contemplated.

Embodiments are also contemplated wherein repeated optimisation may be performed across the tissue or sample.

Although the present invention has been described with reference to preferred embodiments, it will be understood by those skilled in the art that various changes in form and detail may be made without departing from the scope of the invention as set forth in the accompanying claims.

The invention claimed is:

1. A method of ion imaging comprising:

testing a first portion of a sample by automatically varying one or more parameters of an ionisation device;

manually or automatically determining from the first portion one or more optimum or preferred parameters of said ionisation device; and then analysing a second portion of said sample using said one or more optimum or preferred parameters;

wherein said first portion comprises a test portion or sacrificial region of said sample, and said second portion comprises a remaining portion of said sample.

2. A method as claimed in claim 1, wherein the step of testing said first portion of said sample comprises obtaining data from an array of pixels across said first portion.

3. A method as claimed in claim 2, further comprising manually or automatically determining which pixel corresponds with the greatest, optimal or preferred intensity of ions of interest.

4. A method as claimed in claim 3, further comprising manually or automatically determining one or more parameters of said ionisation device which result in the greatest, optimal or preferred intensity of ions of interest.

5. A method as claimed in claim 1, wherein said ionisation device comprises a laser, and the step of automatically varying said one or more parameters comprises automatically varying the number of laser shots per pixel.

6. A method as claimed in claim 1, wherein said ionisation device comprises a laser, and the step of automatically varying said one or more parameters comprises automatically varying the laser energy per pixel.

7. A method of ion imaging comprising:

automatically acquiring an array of mass spectral data from a portion of a sample;

manually or automatically determining one or more optimum or preferred operating conditions from said array of mass spectral data; and ion imaging said sample using said one or more optimum or preferred operating conditions, wherein:

said portion of a sample comprises a test portion on a sacrificial region of said sample; and ion imaging said sample comprises ion imaging a remaining portion of said sample.

8. A method of mass spectrometry comprising a method of ion imaging as claimed in claim 1.

9. A method of mass spectrometry as claimed in claim 8, further comprising ionising said sample using a Matrix Assisted Laser Desorption Ionisation ("MALDI") ion source, a Secondary Ions Mass Spectrometry ("SIMS") ion source, a Desorption Electrospray Ionisation ("DESI") ion source or a Direct Analysis in Real Time ("DART") ion source.

10. A mass spectrometer comprising:

an ionisation device; and a control system arranged and adapted:

(i) to test a first portion of a sample by varying one or more parameters of said ionisation device;

(ii) to determine from the first portion one or more optimum or preferred parameters of said ionisation device; and then (iii) to analyse a second portion of said sample using said one or more optimum or preferred parameters;

wherein said first portion comprises a test portion or a sacrificial region of said sample, and said second portion comprises a remaining portion of said sample.

11. A mass spectrometer as claimed in claim 10, further comprising a Matrix Assisted Laser Desorption Ionisation ("MALDI") ion source, a Secondary Ions Mass Spectrometry ("SIMS") ion source, a Desorption Electrospray Ionisation ("DESI") ion source or a Direct Analysis in Real Time ("DART") ion source.

12. A mass spectrometer comprising:

a control system arranged and adapted:

(i) to acquire an array of mass spectral data from a portion of a sample;

(ii) to determine one or more optimum or preferred operating conditions from said array of mass spectral data; and (iii) to perform ion imaging of said sample using said one or more optimum or preferred operating conditions; wherein:

said portion of a sample comprises a test portion or a sacrificial region of said sample; and ion imaging said sample comprises ion imaging a remaining portion of said sample.

13. A method of ion mapping or ion imaging comprising:

analysing a portion of a sample using a Matrix Assisted Laser Desorption Ionisation ("MALDI") or other laser ion source and automatically varying the intensity of a laser or the number of laser shots per pixel across the portion of said sample;

automatically determining the optimum or preferred laser intensity or the optimum or preferred number of laser shots per pixel; and then ion mapping or ion imaging said sample using the determined optimum or preferred intensity or the optimum or preferred number of laser shots per pixel; wherein:

said portion of a sample comprises a test portion or a sacrificial region of said sample; and ion imaging said sample comprises ion imaging a remaining portion of said sample.

14. An analytical device arranged and adapted to ion map or ion image a sample comprising:

a device arranged and adapted to analyse a portion of sample using a Matrix Assisted Laser Desorption Ionisation ("MALDI") or other laser ion source and to vary the intensity of a laser or the number of laser shots per pixel across the portion of said sample;

a device arranged and adapted to determine the optimum or preferred laser intensity or the optimum or preferred number of laser shots per pixel; and a device arranged and adapted to ion map or ion image said sample using the determined optimum or preferred intensity or the optimum or preferred number of laser shots per pixel; wherein:

said portion of a sample comprises a test portion or a sacrificial region of said sample; and ion imaging said sample comprises ion imaging a remaining portion of said sample.

* * * * *